US010926902B2

(12) United States Patent
Schulz et al.

(10) Patent No.: US 10,926,902 B2
(45) Date of Patent: Feb. 23, 2021

(54) STRAPPING APPARATUS FOR PACKAGES AND STRAPPING METHOD

(71) Applicant: Signode Industrial Group LLC, Glenview, IL (US)

(72) Inventors: Friedhelm Schulz, Wipperfürth (DE); Hans Günther Kastner, Wülfrath (DE); Torsten Oehm, Wuppertal (DE)

(73) Assignee: Signode Industrial Group LLC, Glenview, IL (US)

( * ) Notice: Subject to any disclaimer, the term of this patent is extended or adjusted under 35 U.S.C. 154(b) by 218 days.

(21) Appl. No.: 15/752,167

(22) PCT Filed: Aug. 15, 2016

(86) PCT No.: PCT/US2016/047017
§ 371 (c)(1),
(2) Date: Feb. 12, 2018

(87) PCT Pub. No.: WO2017/027875
PCT Pub. Date: Feb. 16, 2017

(65) Prior Publication Data

US 2018/0237177 A1 Aug. 23, 2018

(30) Foreign Application Priority Data

Aug. 13, 2015 (DE) ..... 10 2015 113 350.4

(51) Int. Cl.
*B65B 13/18* (2006.01)
*B65B 13/06* (2006.01)
*B65B 59/00* (2006.01)

(52) U.S. Cl.
CPC ..... *B65B 13/181* (2013.01); *B65B 13/06* (2013.01); *B65B 59/001* (2019.05)

(58) Field of Classification Search
CPC ..... B65B 13/181; B65B 13/16; B65B 59/00; B65B 59/001; B65B 13/20
(Continued)

(56) References Cited

U.S. PATENT DOCUMENTS 3,241,287 A * 3/1966 Chundelak, Jr. ..... B65B 13/181 53/139.6
3,271,925 A * 9/1966 Aubery ..... B29B 7/566 53/139.6
(Continued)

FOREIGN PATENT DOCUMENTS

CH 406955 A 1/1966
DE 1511759 A 7/1969
(Continued)

OTHER PUBLICATIONS

International Preliminary Report on Patentability issued by ISA/EPO in connection with PCT/US2016/047017 dated Feb. 22, 2018.

*Primary Examiner* — Robert F Long
*Assistant Examiner* — Eduardo R Ferrero
(74) *Attorney, Agent, or Firm* — Levenfeld Pearlstein, LLC

(57) ABSTRACT

A strapping apparatus (10) for packages, has a packing table (11) on which the package (13) to be strapped lies. The apparatus has vertically oriented supports (17) which are arranged laterally on the packing table (11), a horizontally oriented pressing plate (18) which is arranged on the vertical supports (11) and which is movable in a vertical direction, and a device, situated on the pressing plate (18), for the arrangement of an edge protection means on the package (13) lying on the packing table (11). The device for the arrangement of the edge protection means can be moved from an initial position remote from the package into an arrangement position close to the package (13). The device includes at least one magazine (19), arranged on the pressing
(Continued)

plate (18), for the supply of edge protection means and has a first clearance outline profile which is delimited by the packing table (11), the vertical supports (17), the pressing plate (18) and the at least one magazine (19). The magazine (19) has a normal position which, for the transfer of an edge protection means, corresponds to the initial position of the arrangement device, and the magazine (19) is a part of a first clearance outline profile. The magazine (19) has a deflected position into which it can be moved from the normal position and in which the magazine (19) is part of a second, wider clearance outline profile. A method for strapping packages in a strapping apparatus is also disclosed.

16 Claims, 5 Drawing Sheets

(58) Field of Classification Search
USPC ..... 53/397, 399, 139.5, 139.6, 139.7, 589
See application file for complete search history.

(56) References Cited

U.S. PATENT DOCUMENTS 3,378,987 A * 4/1968 Lems ..... B65B 13/181 53/529
3,585,780 A 6/1971 Elmore
3,735,555 A * 5/1973 Pasic ..... B65B 13/181 53/529
3,995,409 A * 12/1976 Discavage ..... B65B 13/18 53/139.6
4,587,791 A * 5/1986 Brouse ..... B65B 13/181 53/139.6
4,700,530 A * 10/1987 Norberg ..... B65B 13/181 53/410
4,878,334 A * 11/1989 Quinn ..... B65B 13/181 53/399
5,226,280 A * 7/1993 Scherer ..... B65B 13/181 53/139.7
5,289,668 A * 3/1994 Meyer ..... B65B 13/181 53/139.7
5,535,572 A * 7/1996 Morantz ..... B65B 11/025 53/139.7
5,546,730 A * 8/1996 Newell ..... B65B 11/585 53/139.7
5,564,254 A * 10/1996 Thimon ..... B65B 11/025 53/139.6
5,596,863 A * 1/1997 Kasel ..... B65B 13/181 53/399
5,758,470 A * 6/1998 Lancaster, III ..... B65B 13/181 53/139.7
5,899,046 A * 5/1999 Hughes ..... B65B 13/181 206/586
6,178,721 B1 * 1/2001 Turfan ..... B65B 11/025 53/139.7
6,883,293 B2 * 4/2005 Lancaster, III ..... B65B 11/025 53/139.7
7,428,865 B1 * 9/2008 Kasel ..... B65B 13/04 100/26
9,932,134 B2 * 4/2018 Suolahti ..... B65B 13/181
10,017,283 B2 7/2018 Kastner
10,099,808 B2 10/2018 Termanas et al.
2002/0014052 A1 * 2/2002 Suolahti ..... B65B 13/181 53/139.7
2004/0216425 A1 * 11/2004 Morton ..... B65B 25/14 53/397
2004/0261360 A1 * 12/2004 Cere ..... B65B 13/181 53/410
2006/0266002 A1 * 11/2006 Zitella ..... B65B 13/181 53/139.7
2016/0114918 A1 * 4/2016 Kastner ..... B65B 13/181 53/139.6
2016/0152363 A1 * 6/2016 Termanas ..... B65B 13/181 53/410

FOREIGN PATENT DOCUMENTS

DE 9311406 U1 11/1993
DE 102013004448 B3 3/2014
DE 202015104275 U1 8/2015
EP 2700577 B1 10/2014
EP 2660158 B1 1/2015
EP 2700578 B1 1/2015
EP 2700579 B1 3/2015
EP 2778075 B1 6/2015
EP 2778076 B1 6/2015
EP 2733077 B1 9/2015
EP 2878541 B1 4/2016
JP S5882814 A 5/1983
WO 2010029451 A1 3/2010
WO 2010061312 A2 6/2010

* cited by examiner

STRAPPING APPARATUS FOR PACKAGES AND STRAPPING METHOD

BACKGROUND

The present disclosure relates to a strapping apparatus for packages, having a packing table on which the package to be strapped lies, having vertically oriented supports which are arranged laterally on the packing table, having a horizontally oriented pressing plate which is arranged on the vertical supports and which is movable in a vertical direction, having a device, situated on the pressing plate, for the arrangement of an edge protection means on the package lying on the packing table, wherein the device for the arrangement of an edge protection means can be moved from an initial position remote from the package into an arrangement position close to the package, having at least one magazine, arranged on the pressing plate, for the supply of edge protection means, having a first clearance outline profile which is delimited by the packing table, the vertical supports, the pressing plate and the at least one magazine.

Also described is a method for the operation of the strapping apparatus.

A generic strapping apparatus is described in the applicant's DE 10 2013 004 448 B3 and shown in FIGS. 1-3, which are reproductions of FIGS. 1-3 of DE 2013 004 448 B3. Said strapping apparatus 10 is a strapping apparatus for large packages 14, which are generally transported on pallets. The strapping apparatus 10 firstly comprises a packing table 11 which is equipped with rollers or drums 12 which serve for the conveyance of the package 14 through the device 10. Then, vertical supports 17 are arranged laterally with respect to the package 14, which supports 17 bear a horizontal pressing plate 16. The pressing plate 16 is vertically movable along the supports 17 and serves for securing the package 14 during the strapping process and, if appropriate, compressing said package 14 to a suitable extent. A strapping channel is formed by various channel sections which are arranged in the pressing plate 16, on the vertical supports 17 and in the packing table 11. In addition or alternatively to the channel section in the packing table 11, it is known for a vertically insertable bayonet to be provided which forms the lower channel section and which permits guidance of the strapping means between skid and pallet deck.

For the strapping process, a strapping means, generally a band, is guided from a feed and sealing closure element in the pressing plate along the channel sections, around the package, and back to the feed and sealing element. Then, the strapping means is retracted and is stretched around the package. Finally, the ends of the strapping means are fixedly connected to one another.

In the case of sensitive packages, such as for example cardboard boxes, the strapping means can lead to damage to the package edges. DE 10 2013 00 448 B3 describes, with regard to the protection of the package edges, how an edge protection means should be dispensed from a magazine into an arrangement device and applied for the purposes of protecting the package edges. For this purpose, magazines 19 are arranged on the pressing plate 16 on the right and on the left close to the vertical supports 17, the discharging elements of which are positioned below the pressing plate 16. As best shown in FIGS. 2 and 3, on the pressing plate 16 there are situated two arrangement devices 32 each movably mounted on a pair of rails 30. When the arrangement devices 32 are in their initial position, they are situated close to the vertical supports 17, correspondingly to the discharging element of the magazines 19. Before the strapping process, edge protection means 20 are transferred to the arrangement devices 32 from the magazines 19. The arrangement devices 32 move into their respective arrangement position determined by the package 14. The pressing plate 16 is then lowered onto the package 14, wherein the edge protection means 20 come into contact between the package 14 and pressing plate 16. The arrangement devices 32 can then be moved back into their initial positions. The strapping process begins as described above. During the strapping process, the strapping means lies against the package edges via the edge protection means, such that damage to the package edges is prevented in an effective manner.

Generic strapping apparatuses exist in different sizes, which are defined in particular by their clearance outline profile. Here, in particular, the width of the clearance outline profile, which defines the maximum package width to be processed, plays a major role.

Since the packages to be strapped vary in terms of their size, there is, in the procurement of generic strapping apparatuses, the need to resolve a conflict of aims between variability in use—that is to say the possibility of processing as wide a variety of different sizes of packages as possible—and the strapping speed, that is to say the processing efficiency. The larger the strapping apparatus, the more variably it can be used. At the same time, however, the mean strapping speed, measured across all package sizes, decreases with the size of the clearance outline profile. The strapping time is made up firstly of the so-called feeding process, which is directly dependent on the length of the strapping channel and thus on the clearance outline profile. Then, the retraction and stretching of the strapping band around the package plays a further considerable role. The smaller the package in relation to the clearance outline profile, the longer the retraction of the strapping band takes.

Since the economy of strapping apparatuses is dependent in particular on the mean strapping speed, there are numerous situations in which said conflict of aims cannot be resolved in a satisfactory manner. Either a decision is made in favor of economy, such that oversized packages which are not suitable for the given machine size cannot be strapped in automated fashion, or a decision is made in favor of variability, which reduces the economy of the procured installation.

SUMMARY

It is an object of the device and method to realize a strapping apparatus which ensures adequate variability with regard to the package sizes to be processed, while exhibiting a high strapping speed.

The object is achieved by a device according to which the magazine has a normal position which, for the transfer of an edge protection means, corresponds to the initial position of the arrangement device, and said magazine is a part of a first clearance outline profile, and the magazine has a deflected position into which it can be moved from the normal position and in which said magazine is part of a second, wider clearance outline profile.

Instead of the obvious solution of equipping an adequately large strapping apparatus with a more powerful feed and sealing element, and thereby accelerating the strapping process even in the case of small packages, the disclosure follows a different path. In the disclosure it is recognized that, in cases of a conflict of aims which cannot be resolved in optimum fashion, although there is the pressing demand to make it possible for even oversized packages in relation to an economical machine size to be strapped in automated fashion, the actual number of such packages is however relatively low. In the disclosure, it is also recognized that a variable clearance outline profile can be provided by way of a movement of the magazines for the edge protection means. The movement of the magazines out of the movement path of oversized packages through the strapping apparatus therefore makes it possible, in principle, to process oversized packages on a strapping apparatus which is otherwise unsuitable because it is too small. Furthermore, the disclosure has recognized that the time required for the variation of the clearance outline profile by movement of the magazines out of the movement path of the package is duly considerable for the individual strapping process, but has little influence on the calculation of the average strapping time owing to the fact that predominantly relatively small packages are processed. As a result, in an embodiment of the strapping apparatus, the clearance area of which is not suitable for the processing of oversized packages when the magazines for edge protection means are in the normal position, is capable, by way of an embodiment with magazines that can be moved into a deflected position, of processing even oversized packages and thus resolving the existing conflict of aims.

It is provided that the magazine is movable horizontally or vertically from the normal position into the deflected position. The optimum movement path for the magazines may be selected in accordance with the conditions.

A further embodiment provides that the magazine is movable by way of a spindle drive from its normal position into its deflected position.

Specifically, it is provided that the magazine is, in its deflected position, arranged behind or in front of one of the vertical supports in relation to a movement path of the package through the strapping apparatus.

Alternatively, it may conceivably be provided that the magazine, in its deflected position, is arranged vertically above a package contact surface of the pressing plate.

The disclosure also encompasses a method for strapping packages in a strapping apparatus. Said method uses method steps, wherein a) the package is arranged under the pressing plate, b) an edge protection means is transferred from the magazine to the arrangement device, c) the arrangement device is moved into an arrangement position, d) the pressing plate is lowered onto the package and holds the edge protection means between itself and the package, e) a strapping means is laid around the package.

An embodiment of the method is characterized in that, before step d), the magazine is moved from its normal position into its deflected position.

In a method, before the pressing plate is set down onto the package, the magazines are moved into their deflected position such that said process, which is not possible in the prior art owing to the clearance outline profile, the width and height of which are delimited by the normal position of the magazines, is made possible.

DESCRIPTION OF THE FIGURES

Further advantages and improved understanding of the device and method will emerge from the following description of the drawing, in which.

DETAILED DESCRIPTION

Figure 1:
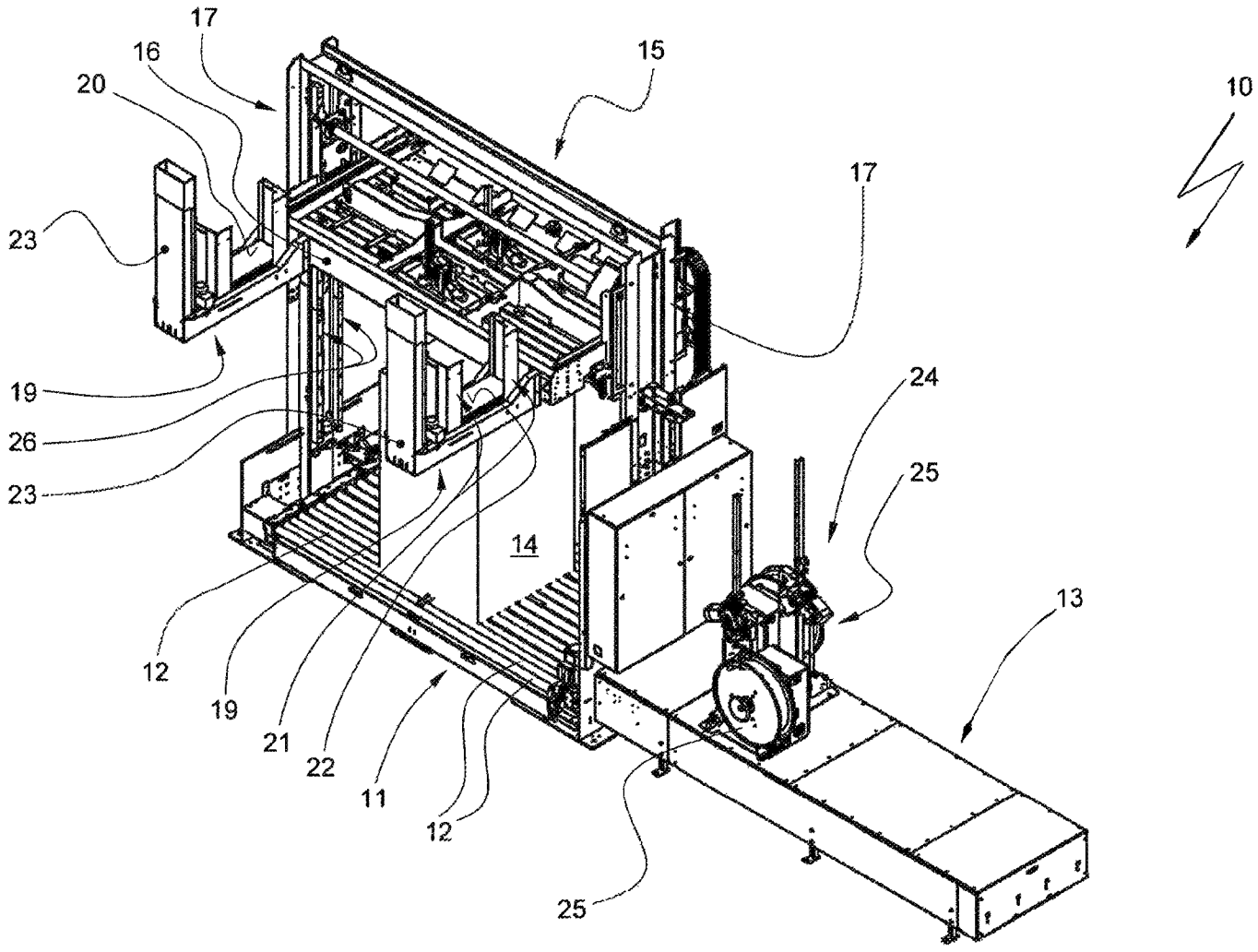
PRIOR ART Fig. 1
FIGS. 1-3 are reproductions of FIGS. 1-3 of DE 10 2013 004 448 B3 and are perspective views of a prior art strapping apparatus.

In the figures, an embodiment of a strapping apparatus is denoted as a whole by the reference designation 110.

The strapping apparatus 110 firstly has a packing table 111 which bears drums 112 on which a package 113 can be moved through the apparatus 110. In the present example, the package 113 is composed of a load carrier 114 in the form of a pallet 115, on which there are arranged cardboard boxes 116 (illustrated merely schematically).

To the left and to the right of the packing table 111 there is situated in each case one vertical support 117, which vertical supports hold a horizontally oriented pressing plate 118 which is arranged above the packing table 111. The pressing plate 118 is movable along the vertical supports 117 in a vertical direction V upward and downward in the direction of the packing table 111.

Figure 2:
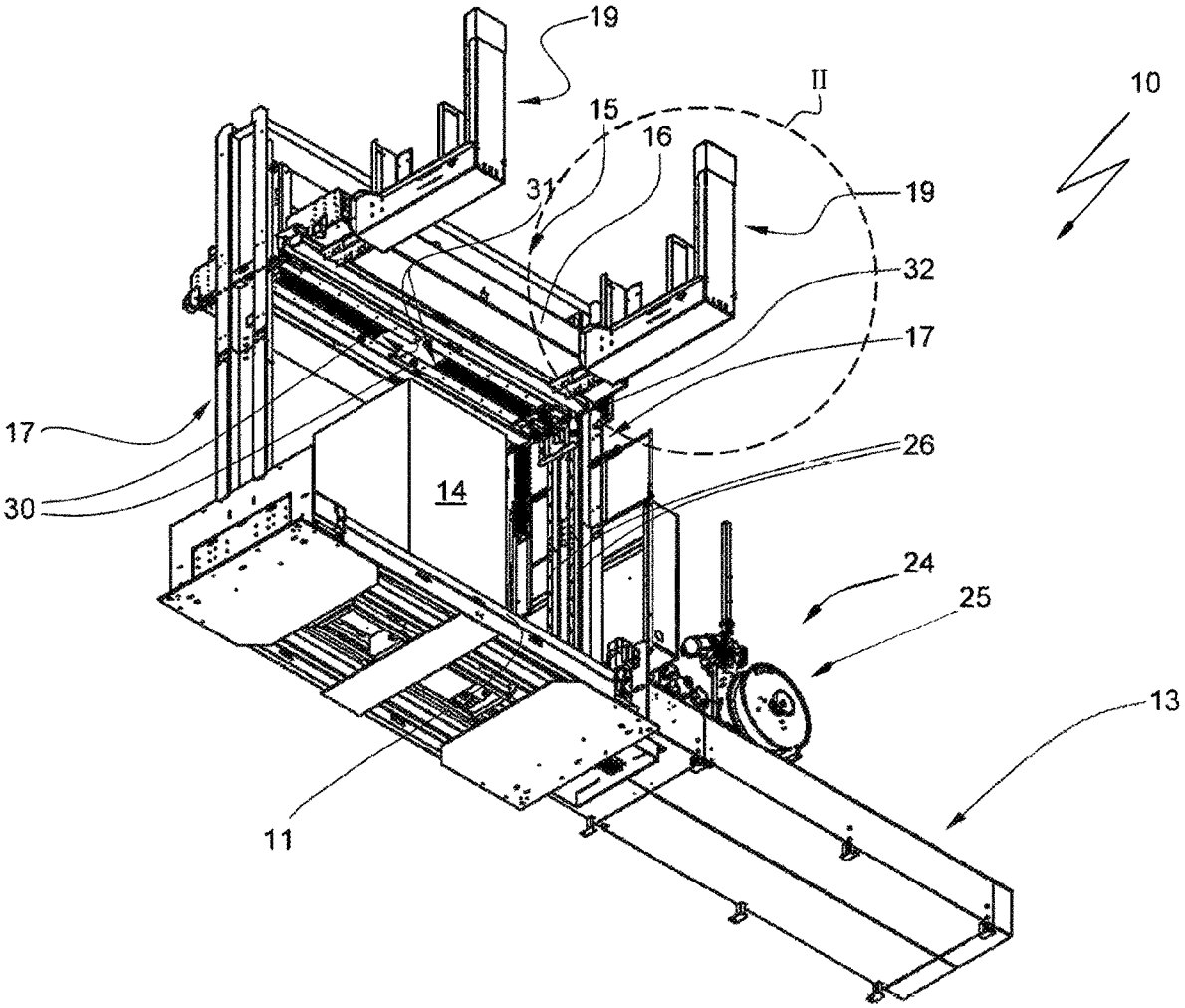
PRIOR ART Fig. 2
Figure 3:
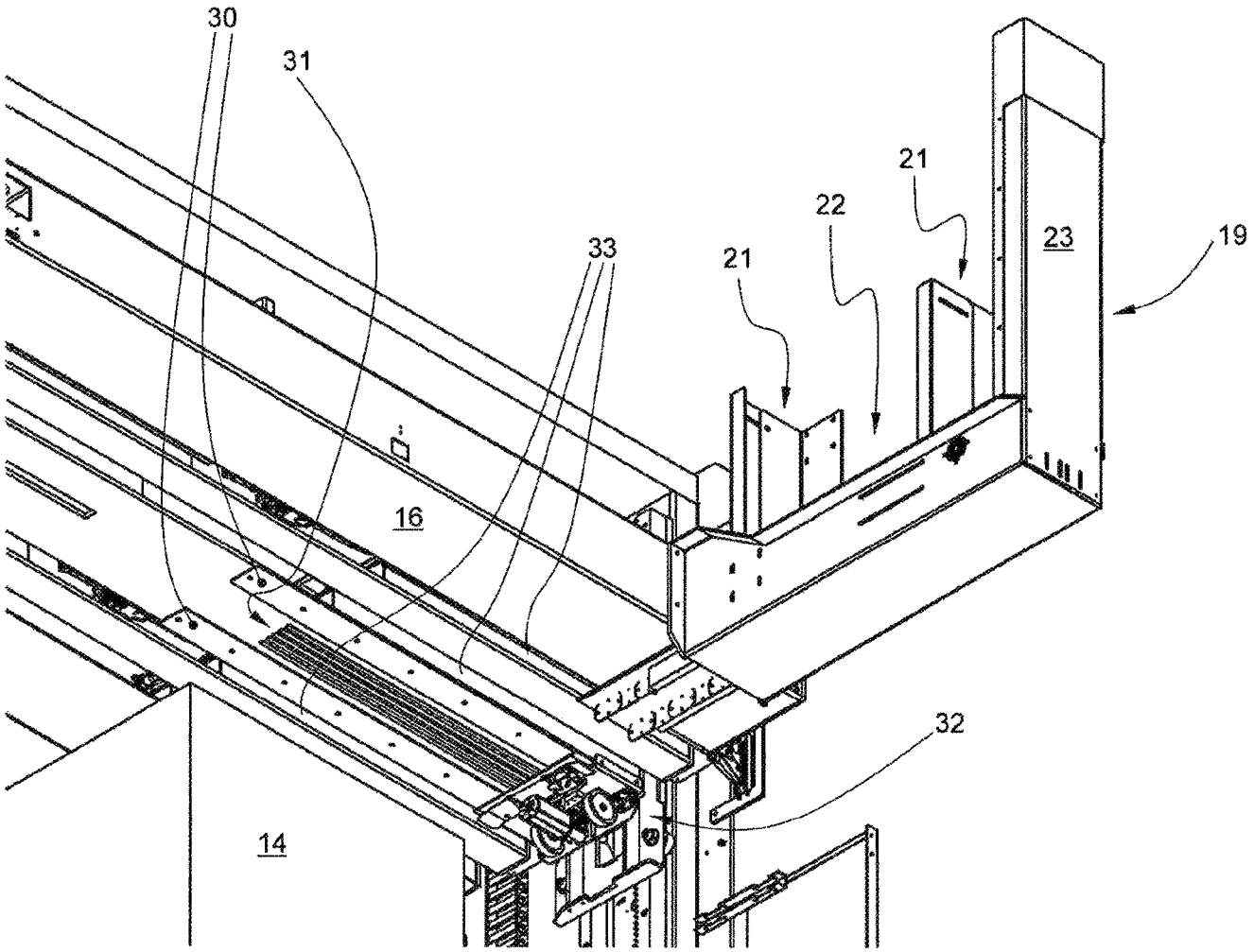
PRIOR ART Fig. 3

To the pressing plate 118, close to each vertical support 117, there is fastened in each case one magazine 119 which serves for the supply of edge protection means (not illustrated). The pressing plate 118, above its underside 120 which is provided for making contact with the package 111, has running rails on which arrangement devices (not illustrated here but similar to those shown in the prior art strapping apparatus shown in FIGS. 1-3) for edge protection means are arranged in movable fashion. Two such arrangement means are provided, which, in their initial position, are arranged behind the respective magazines 119 in relation to the drawing plane of FIG. 4. Said arrangement means receive edge protection means from a discharging element (not illustrated) of the respective magazine 119, which edge protection means are conveyed by said arrangement means to an arrangement position on the package.

The strapping apparatus 110 then has a strapping means channel which surrounds the package and which runs in the pressing plate 118, along the vertical supports 117 and in the region of the packing table 111, wherein the channel section in the region of the package 113 may alternatively be formed by a horizontally insertable bayonet.

The reference designation 121 denotes the band stores of the strapping apparatus, which hold a supply of strapping means.

Figure 4:
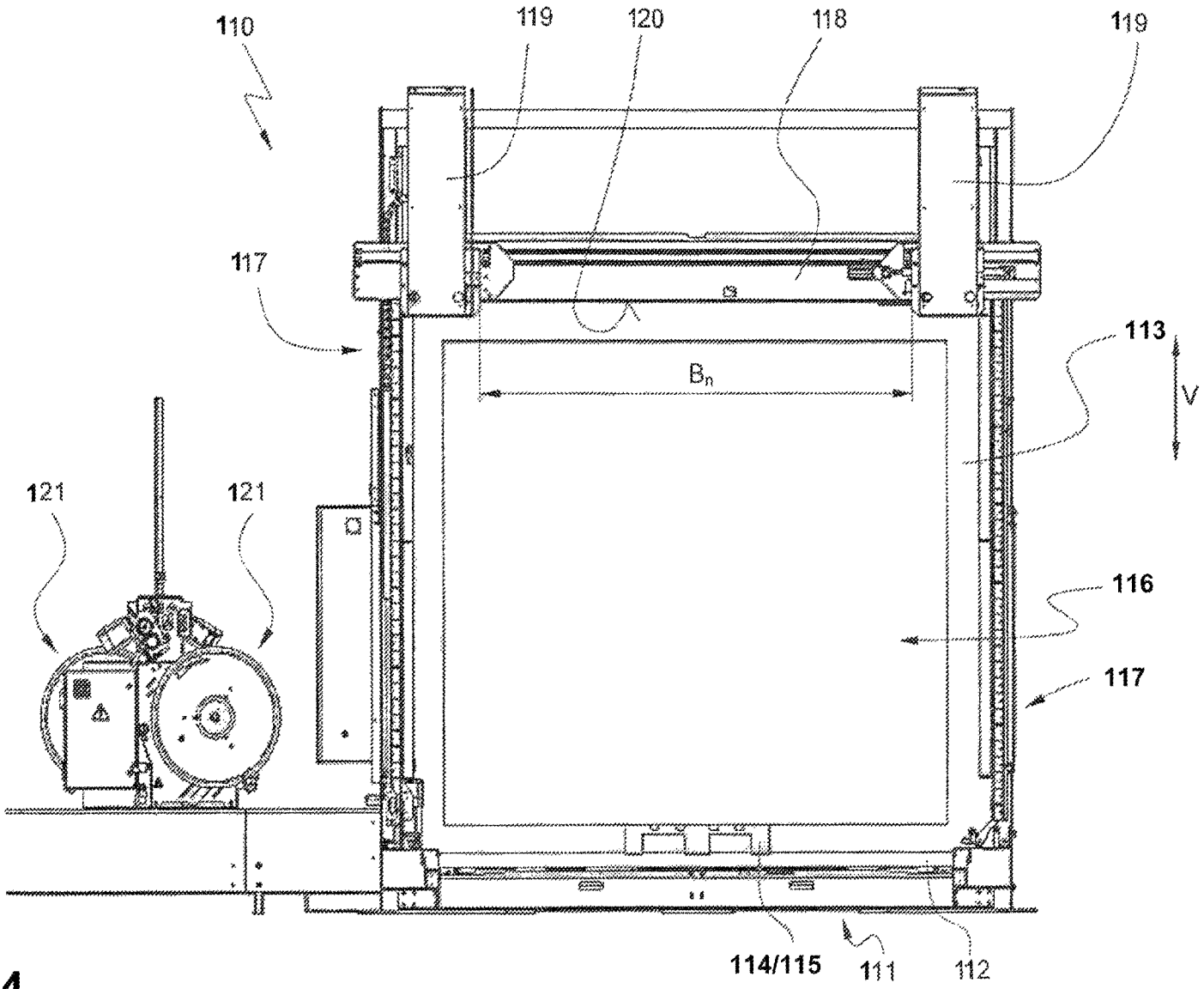
FIG. 4 shows an embodiment of a strapping apparatus, illustrated with magazines in a normal position.

In FIG. 4, the strapping apparatus 110 has a first clearance outline profile, the dimensions of which define the maximum size of a package to be processed. It is clear from FIG. 4 that, in the case of the magazines 119 being arranged in a normal position, said magazines define the width $B_n$ of the first clearance outline profile. The width $B_n$ of the first clearance outline profile is in this case thus defined by the spacing of the magazines 119 to one another, because the discharging elements thereof are arranged below the underside 120 of the pressing plate 118. It can also be seen from FIG. 4 that the package 113 positioned there exceeds the width $B_n$ of the first clearance outline profile and thus cannot be processed with magazines 119 in the normal position.

Figure 5:
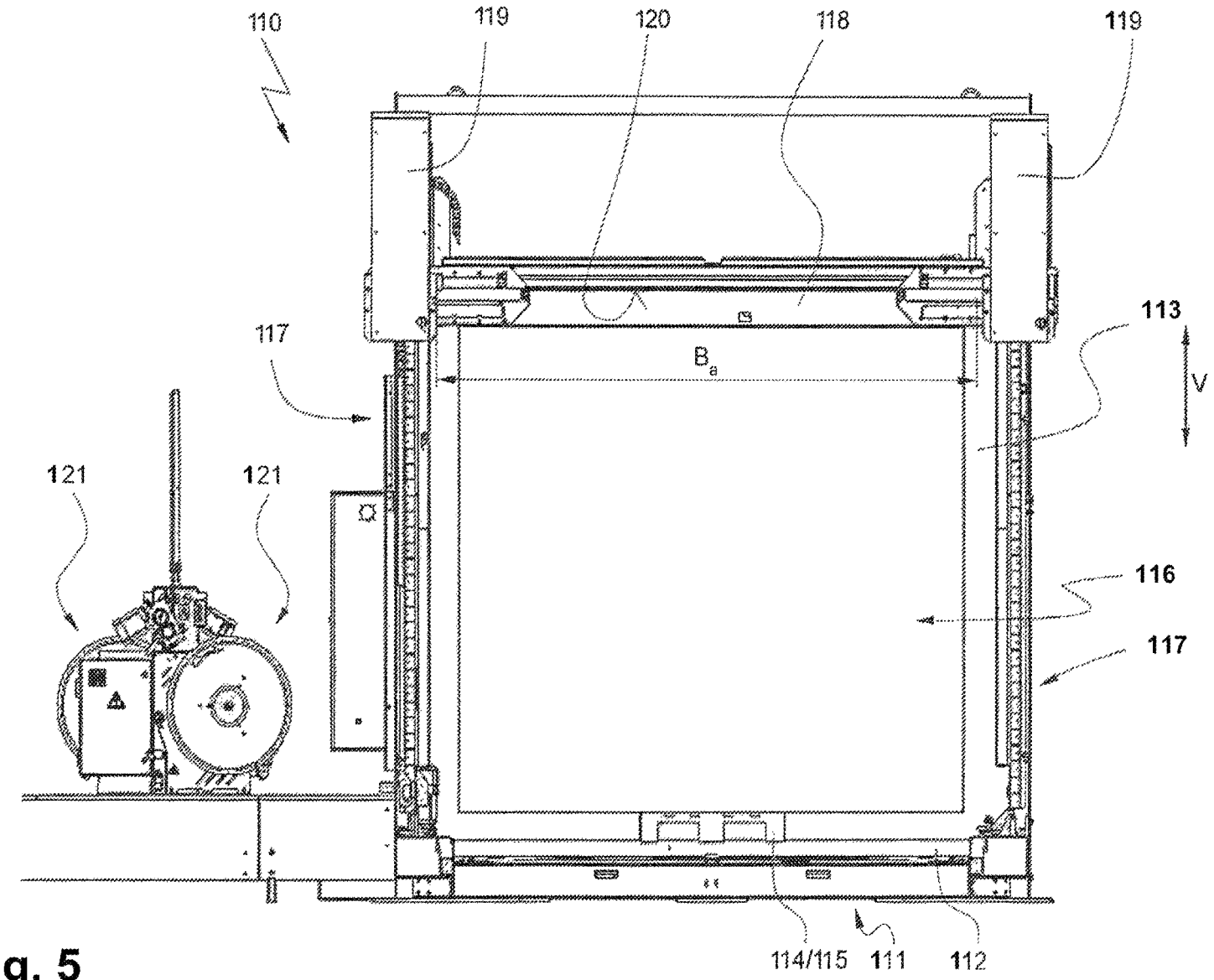
FIG. 5 shows the strapping apparatus as per FIG. 4 with magazines in a deflected position.

In an embodiment of the strapping apparatus 110, it is possible for the magazines 119 to be moved from their normal position illustrated in FIG. 4, which is required for the transfer of edge protection means to the arrangement device, into a deflected position illustrated in FIG. 5. In the exemplary embodiment, a movement in a horizontal direction has been realized, in the case of which the deflected position has been assumed when the magazines 119 are arranged in front of the vertical supports 117 with respect to the plane of the paper. In their deflected position, the magazines 119 are arranged outside the movement path of the package 111 through the device 110, such that the magazines 119 now define a second clearance outline profile with the width $B_a$. Said width $B_a$ is considerably greater than the width $B_n$ illustrated in FIG. 4, such that the package 113 can be processed in the installation with magazines in the deflected position as per FIG. 5. In this way, it is possible for the variability of the strapping apparatus 110 with regard to processable package sizes to be increased.

In the exemplary embodiment, the horizontal movement of the magazines 119 into the deflected position is realized by way of a spindle drive. Alternative drives are self-evidently conceivable. It is also readily possible to provide not a horizontal, sidewardly directed movement of the magazines but also a vertically upwardly directed movement, such that the deflected position of the magazines 119 would then be situated above the underside 120 of the package.

The conventional strapping process with magazines 119 in the normal position as per FIG. 4, and with a package adapted to the first clearance outline profile, takes place as follows:

The package 113 is placed onto the packing table 111 and is moved under the pressing plate 118 in the region of the strapping channel. Edge protection means are conveyed from the magazines 119 to the respective arrangement device. The arrangement devices move into an arrangement position in which the edge protection means can be arranged on the package. The pressing plate 118 is lowered onto the package 113. The edge protection means are now held, in the region of the package edges, between pressing plate 118 and package 113. The arrangement devices move back into their initial position.

A feed and sealing element (not illustrated) situated in the pressing plate 118 pushes the strapping means along the channel sections, which are situated in the pressing plate 118, arranged on the vertical supports 117 and situated in the packing table 111, and around the package 113. The end of the feeding process is reached when the band end arrives at the feed and sealing element again. There, the band end is held, and the band is retracted and stretched around the package. Here, the band is pulled out of the strapping means channel, which for this purpose may have various opening mechanisms. After the strapping means has been stretched around the package 113, the band ends are connected to one another by the feed and sealing element, and the strapping process is complete.

In relation to this, an embodiment of the strapping process of the device 110, changes as follows if it is necessary for the magazines 119 to be moved into deflected positions:

As described above, with the magazines 119 in the normal position, the edge protection means are transferred to the arrangement devices, which are situated in their initial position. Before the lowering of the pressing plate 118 onto the package 113, the magazines 119 are then moved into their deflected position in order to widen the clearance outline profile. Then, the pressing plate 118 is lowered onto the package 113, and the strapping process is then performed as described above. At the end of the strapping process, the pressing plate 118 is raised, wherein then, in preparation for the processing of the next package 113, the magazines 119 are moved back into their normal position.

The strapping apparatus according to the present disclosure can be used expediently whenever oversized packages 113, which cannot be processed when the magazines 119 are in the normal position, make up a relatively small fraction of the strapping processes, such that the use of an apparatus 110 with a relatively large clearance outline profile is not expedient. Said strapping apparatus is thus suitable whenever the conflict of aims mentioned above cannot be solved in a satisfactory manner.

LIST OF REFERENCE DESIGNATIONS

110 Strapping apparatus
111 Packing table
112 Drums
113 Package
114 Load carrier
115 Pallet
116 Cardboard packaging
117 Vertical supports
118 Pressing plate
119 Magazine
120 Underside of 118
121 Band store
$B_a$ Width of the clearance outline profile in the deflected position of 119
$B_n$ Width of the clearance outline profile in the normal position of 119
V Vertical direction

The invention claimed is:

1. A strapping machine comprising:

a packing table having vertically oriented supports arranged laterally on the packing table;

a horizontally oriented pressing plate arranged on the vertical supports and movable in a vertical direction;

an arrangement device, situated on the pressing plate, for the arrangement of an edge protector on a package positioned on the packing table, wherein the arrangement device is movable horizontally from an initial position remote from the package into an arrangement position closer to the package, and a magazine arranged on the pressing plate and configured to supply edge protectors;

wherein a first clearance outline profile is delimited by the packing table, the vertical supports, the pressing plate and the magazine, wherein the magazine has a normal position which, for the transfer of an edge protector, corresponds to the initial position of the arrangement device, and said magazine is a part of the first clearance outline profile, and wherein the magazine is movable relative to the arrangement device from the normal position to a deflected position in which said magazine is part of a second, wider clearance outline profile.

2. The strapping apparatus of claim 1, wherein the magazine is movable vertically from the normal position into the deflected position.

3. The strapping apparatus of claim 1, wherein the magazine is movable by way of a spindle drive from the normal position into the deflected position.

4. The strapping apparatus of claim 1, wherein the magazine is, in its deflected position, arranged behind or in front of one of the vertical supports in relation to a movement path of the package through the strapping apparatus.

5. The strapping apparatus of claim 1, wherein the magazine, in its deflected position, is arranged vertically above a package contact surface of the pressing plate.

6. A method for strapping packages in a strapping apparatus, the method comprising:

a) arranging the package under a pressing plate;

b) transferring an edge protector from the magazine to an arrangement device that is at an initial position;

c) moving the arrangement device horizontally from the initial position into an arrangement position;

d) moving the magazine relative to the arrangement device from a normal position into a deflected position; and e) lowering the pressing plate onto the package and holding the edge protector between the pressing plate itself and the package; and f) applying a strap around the package.

7. A strapping machine comprising:

first and second side supports;

a packing table at least partially between the first and second side supports;

a pressing plate mounted on the first and second side supports and movable relative to the first and second side supports toward and away from the packing table;

first and second magazines supported by the pressing plate and each configured to store multiple edge protectors, the first and second magazines movable between a first configuration in which a first horizontal distance separates the first and second magazines and a second configuration in which a second horizontal distance greater than the first horizontal distance separates the first and second magazines;

a first arrangement device configured to receive an edge protector from the first magazine and later discharge the edge protector, wherein the first arrangement device is horizontally movable between a first initial position and a first arrangement position; and a second arrangement device configured to receive an edge protector from the second magazine and later discharge the edge protector, wherein the second arrangement device is horizontally movable between a second initial position and a second arrangement position, wherein the first and second magazines are movable relative to the first and second arrangement devices between the first and second configurations.

8. The strapping machine of claim 7, further comprising a drive operably connected to the first and second magazines to move the first and second magazines between the first and second configurations.

9. The strapping machine of claim 8, wherein the drive is operably connected to the first and second magazines to translate the first and second magazines horizontally outward to move the first and second magazines from the first configuration to the second configuration.

10. The strapping machine of claim 8, wherein the drive comprises a spindle drive.

11. The strapping machine of claim 7, wherein when the first and second magazines are in the first configuration and the first and second arrangement devices are in their first and second initial positions, the first and second arrangement devices are positioned to receive an edge protector from the first and second magazines, respectively.

12. The strapping machine of claim 11, wherein the first and second arrangement devices are movable horizontally inwardly from their initial positions to their arrangement positions to discharge the edge protectors onto a load.

13. The strapping machine of claim 7, wherein the first and second arrangement devices are supported by the pressing plate.

14. The method of claim 6, further comprising moving the magazine from the normal position into the deflected position after transferring the edge protector to the arrangement device.

15. The method of claim 14, further comprising moving the magazine horizontally from the normal position into the deflected position.

16. The method of claim 14, further comprising moving the magazine from the normal position into the deflected position before the pressing plate engages the edge protector.

* * * * *